US005487475A

United States Patent [19]

Knee

[11] Patent Number: 5,487,475

[45] Date of Patent: Jan. 30, 1996

[54] FISHING EQUIPMENT STORAGE APPARATUS

[76] Inventor: Raymond W. Knee, 118 Wright Rd., Delta, Pa. 17314

[21] Appl. No.: 352,398

[22] Filed: Dec. 8, 1994

[51] Int. Cl.[6] ..... A47F 7/00

[52] U.S. Cl. ..... 211/70.8; 211/89; 211/90; D6/552

[58] Field of Search ..... 43/54.1; 211/70.8, 211/65, 70.5, 70.2, 90, 89; D6/552; D21/223; 206/315.11

[56] References Cited

U.S. PATENT DOCUMENTS

| | | | |
|---|---|---|---|
| D. 256,303 | 8/1980 | Rieman | D6/552 |
| 2,854,147 | 9/1958 | Derr | 211/70.8 |
| 4,986,427 | 1/1991 | Law et al. | 211/70.8 X |

*Primary Examiner*—P. Austin Bradley

*Assistant Examiner*—Jeanne M. Elpel

[57] ABSTRACT

A new and improved fishing equipment storage apparatus comprising a vertical rectangular base having an aperture formed therethrough. The aperture serves to allow the vertical rectangular base to be mounted to a wall. An upper panel is integral with the vertical rectangular base downwardly of the aperture formed therethrough. The upper panel has a plurality of soft foam strips secured to a front surface thereof. The plurality of soft foam strips serve to receive fishing rod tips securably therein. Included in the device is an upper shelf having an extension integral therewith. The extension has an upper portion of a shelf bracket secured thereto. A lower portion of the shelf bracket is secured to the vertical rectangular base downwardly of the upper panel. A bottom panel is integral with the vertical rectangular panel upwardly of a lower end thereof. The bottom panel has a plurality of recesses therein. The recesses serve to receive ends of the fishing rods therein.

6 Claims, 4 Drawing Sheets

FISHING EQUIPMENT STORAGE APPARATUS

BACKGROUND OF THE INVENTION

1. Field of the Invention

The present invention relates to a fishing equipment storage apparatus and more particularly pertains to organizing fishing gear so that it can all be kept in one place with a fishing equipment storage apparatus.

2. Description of the Prior Art

The use of fishing rod storage devices is known in the prior art. More specifically, fishing rod storage devices heretofore devised and utilized for the purpose of storing fishing rods are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,257,700 to Wallace discloses a fishing rod support rack.

U.S. Pat. No. 5,097,771 to James, III discloses a wall mounted shelf unit.

U.S. Pat. No. 4,780,983 to Smith discloses a fishing rod storage apparatus.

U.S. Pat. No. Des. 286,742 to Gohrig discloses the ornamental design for a combined standard and bracket for wall mounted shelves.

U.S. Pat. No. 4,133,131 to Davy discloses a fishing rod storage and support apparatus.

While these devices fulfill their respective, particular objective and requirements, the aforementioned patents do not describe a fishing equipment storage apparatus for organizing fishing gear so that it can all be kept in one place.

In this respect, the fishing equipment storage apparatus according to the present invention substantially departs from the conventional concepts and designs of the prior art, and in doing so provides an apparatus primarily developed for the purpose of organizing fishing gear so that it can all be kept in one place.

Therefore, it can be appreciated that there exists a continuing need for new and improved fishing equipment storage apparatus which can be used for organizing fishing gear so that it can all be kept in one place. In this regard, the present invention substantially fulfills this need.

SUMMARY OF THE INVENTION

In the view of the foregoing disadvantages inherent in the known types of fishing rod storage devices now present in the prior art, the present invention provides an improved fishing equipment storage apparatus. As such, the general purpose of the present invention, which will be described subsequently in greater detail, is to provide a new and improved fishing equipment storage apparatus and method which has all the advantages of the prior art and none of the disadvantages.

To attain this, the present invention essentially comprises a vertical rectangular base having a first end, a second end, an intermediate extent therebetween, and two side portions. The rectangular base has an aperture formed therethrough downwardly of the first end. The aperture serves to allow the vertical rectangular base to be mounted to a wall. An upper panel is integral with the vertical rectangular base downwardly of the aperture formed therethrough. The upper panel extends outwardly from the rectangular base from the two side portions thereof. The upper panel has a plurality of soft foam strips that are secured to a front surface thereof. The plurality of soft foam strips serve to receive fishing rod tips securably therein. The device contains an upper shelf having an upper surface, a lower surface, a front end, and a back end. The back end has an extension integral therewith. The front end has a plurality of cutouts therein. The cutouts serve to allow hip boots or chest waders to be hung therefrom. The lower surface of the extension has an upper portion of a shelf bracket secured thereto. A lower portion of the shelf bracket is secured to the intermediate extent of the vertical rectangular base downwardly of the upper panel. A hook is secured to the lower surface of the upper shelf inwardly of the front end. The device contains a middle shelf having an upper surface, a lower surface, a front end, and a back end. The back end has an extension integral therewith. The lower surface of the extension has an upper portion of a shelf bracket secured thereto. A lower portion of the shelf bracket is secured to the intermediate extent of the vertical rectangular base downwardly of the upper shelf. The device contains a lower shelf having an upper surface, a lower surface, a front end, and a back end. The back end has an extension integral therewith. The lower surface of the extension has an upper portion of a shelf bracket secured thereto. A lower portion of the shelf bracket is secured to the intermediate extent of the vertical rectangular base downwardly of the middle shelf. A bottom panel is integral with the vertical rectangular panel upwardly of the second end thereof. The bottom panel extends outwardly from the rectangular base from the two side portions thereof. The bottom panel has a plurality of recesses therein. The recesses serve to receive ends of the fishing rods therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fishing equipment storage apparatus which has all the advantages of the prior art fishing rod storage devices and none of the disadvantages.

It is another object of the present invention to provide a new and improved fishing equipment storage apparatus which may be easily and efficiently manufactured and marketed.

It is a further object of the present invention to provide a new and improved fishing equipment storage apparatus which is of durable and reliable construction.

An even further object of the present invention is to provide a new and improved fishing equipment storage apparatus which is susceptible of a low cost of manufacture with regard to both materials and labor, and which accordingly is then susceptible of low prices of sale to the consuming public, thereby making such a fishing equipment storage apparatus economically available to the buying public.

Still yet another object of the present invention is to provide a new and improved fishing equipment storage apparatus which provides in the apparatuses and methods of the prior art some of the advantages thereof, while simultaneously overcoming some of the disadvantages normally associated therewith.

Even still another object of the present invention is to provide a new and improved fishing equipment storage apparatus for organizing fishing gear so that it can all be kept in one place.

Lastly, it is an object of the present invention to provide a new and improved fishing equipment storage apparatus comprising a vertical rectangular base having an aperture formed therethrough. The aperture serves to allow the vertical rectangular base to be mounted to a wall. An upper panel is integral with the vertical rectangular base downwardly of the aperture formed therethrough. The upper panel has a plurality of soft foam strips secured to a front surface thereof. The plurality of soft foam strips serve to receive fishing rod tips securably therein. Included in the device is an upper shelf having an extension integral therewith. The extension has an upper portion of a shelf bracket secured thereto. A lower portion of the shelf bracket is secured to the vertical rectangular base downwardly of the upper panel. A bottom panel is integral with the vertical rectangular panel upwardly of a lower end thereof. The bottom panel has a plurality of recesses therein. The recesses serve to receive ends of the fishing rods therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
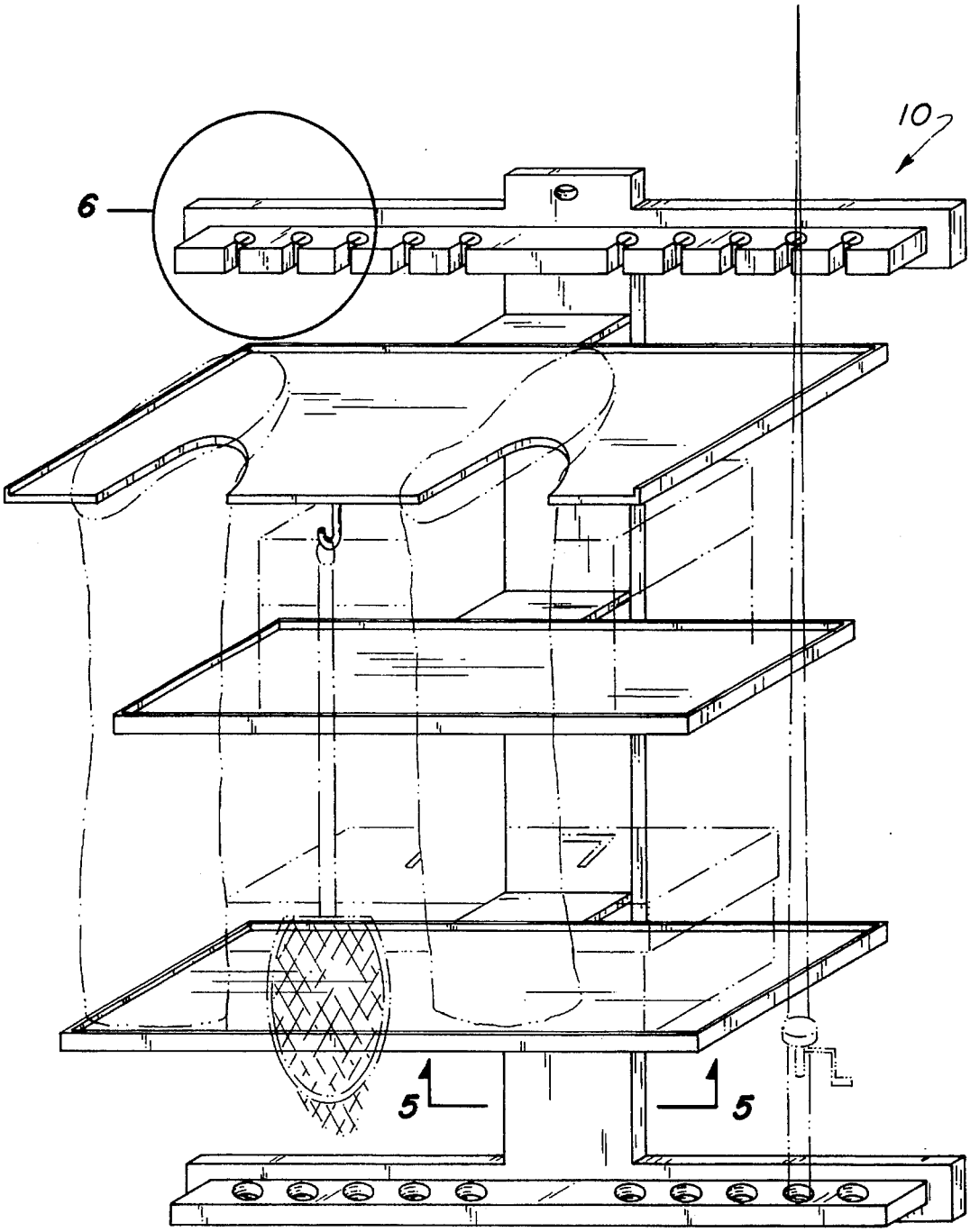
FIG. 1 is a perspective view of the preferred embodiment of the fishing equipment storage apparatus constructed in accordance with the principles of the present invention.
Figure 3:
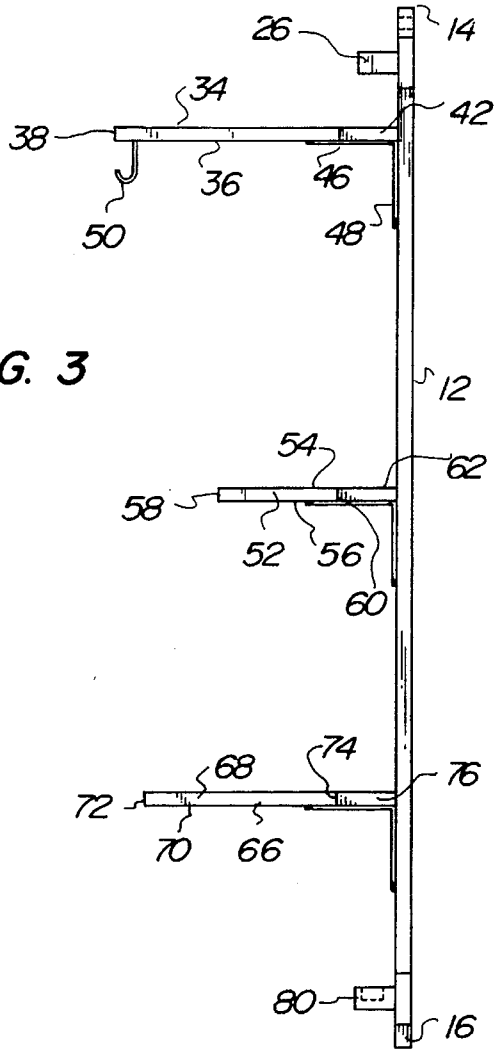
FIG. 3 is a side elevation view of the present invention.
Figure 2:
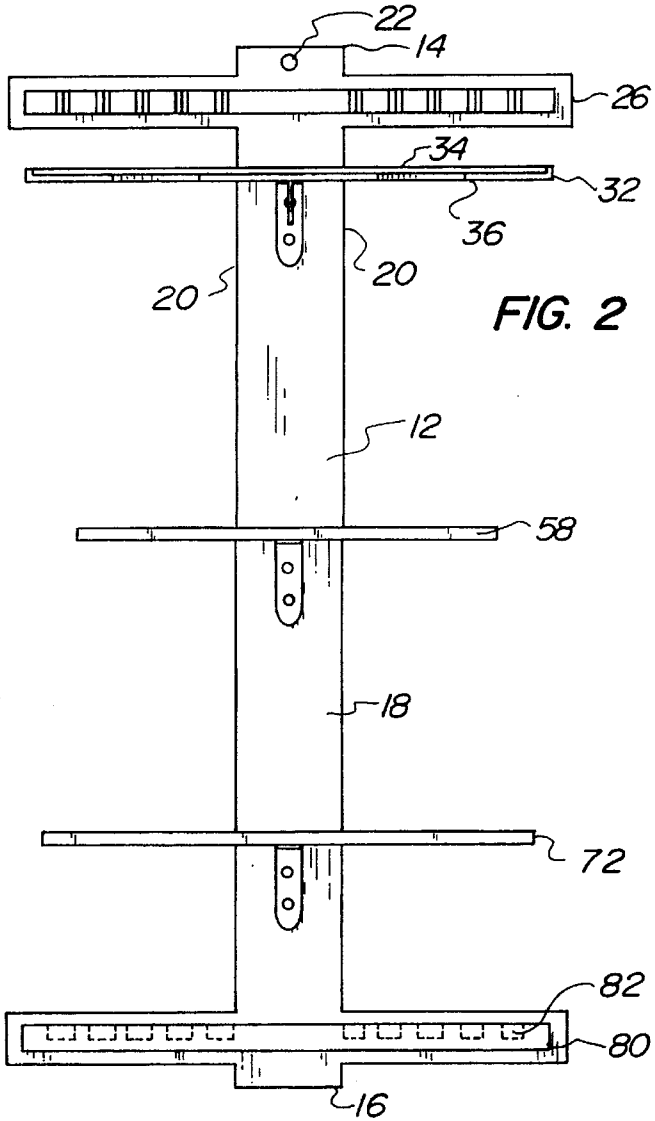
FIG. 2 is a front elevation view of the present invention.
Figure 5:
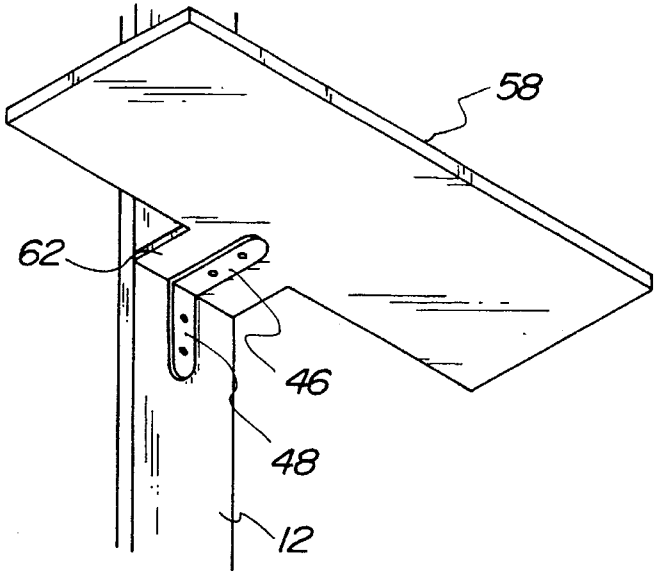
FIG. 5 is a partial perspective view of the shelf and bracket of the present invention.
Figure 4:
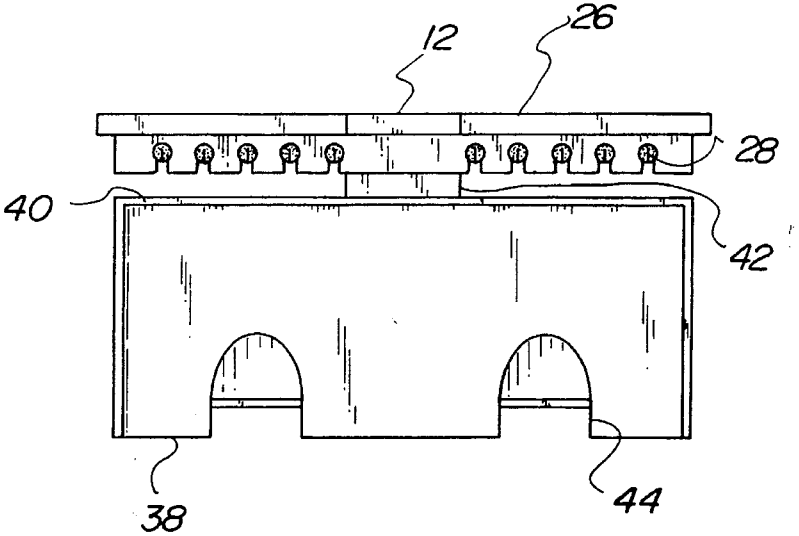
FIG. 4 is a plan view of the preferred embodiment of the present invention.
Figure 7:
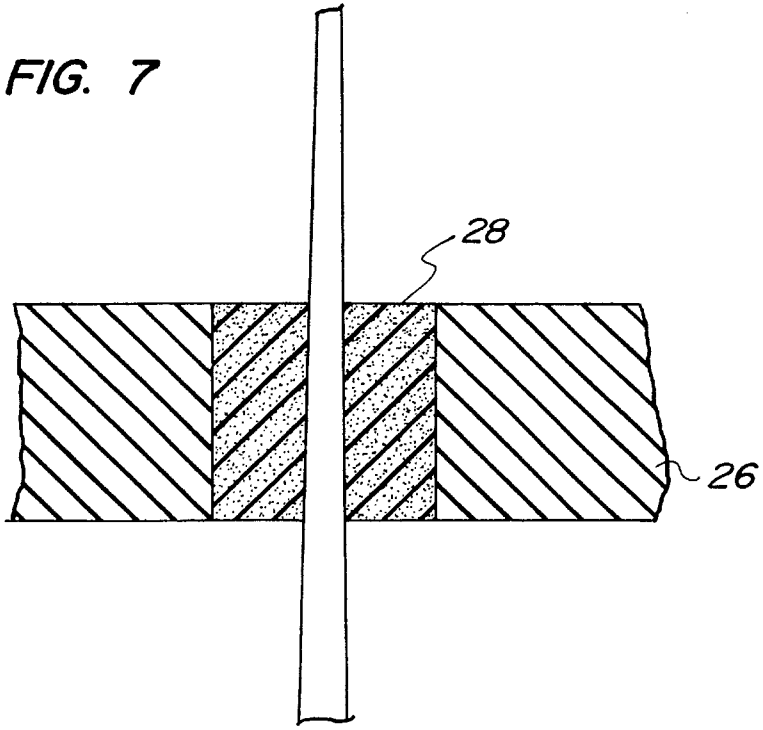
FIG. 7 is a cross-sectional view as taken along line 7—7 of FIG. 6.
Figure 6:
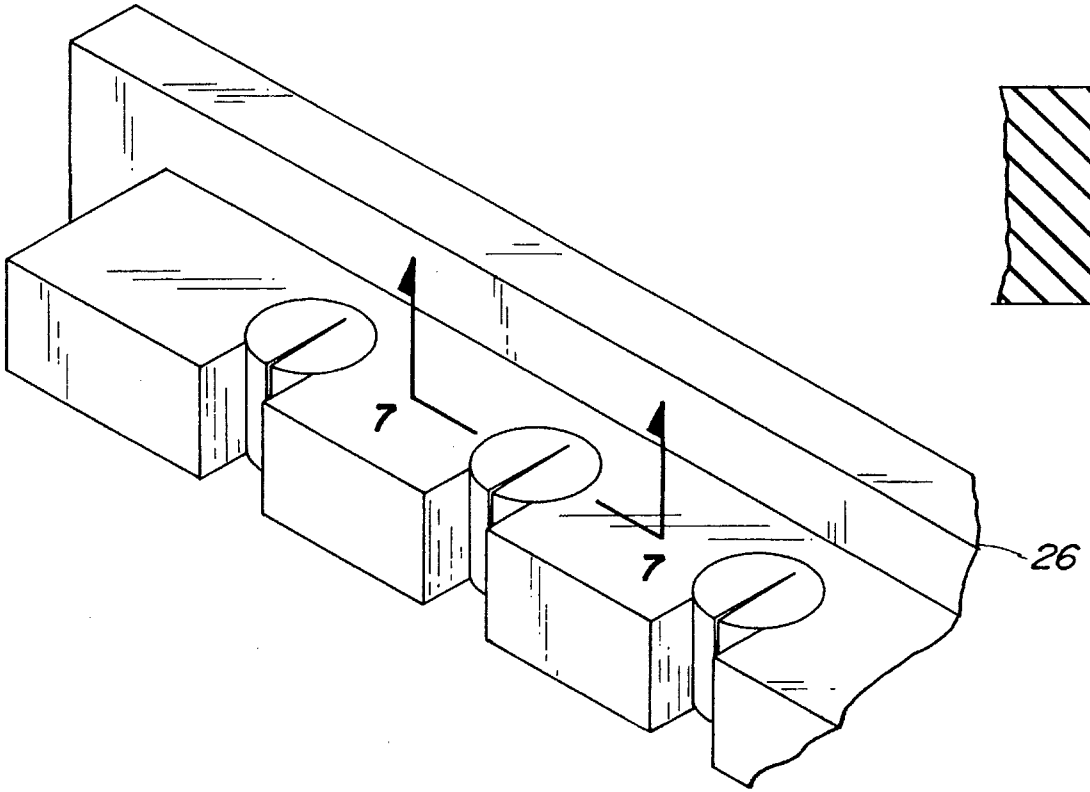
FIG. 6 is a partial perspective view of the rod holders of the present invention.

With reference now to the drawings, and in particular, to FIG. 1 thereof, the preferred embodiment of the new and improved fishing equipment storage apparatus embodying the principles and concepts of the present invention and generally designated by the reference number 10 will be described.

Specifically, it will be noted in the various Figures that the device relates to a new and improved fishing equipment storage apparatus for organizing fishing gear so that it can all be kept in one place. In its broadest context, the device consists of a vertical rectangular base, am upper panel, an upper shelf, a middle shelf, a lower shelf, and a bottom panel.

The device 10 contains a vertical rectangular base 12 having a first end 14, a second end 16, an intermediate extent 18 therebetween, and two side portions 20. The rectangular base 12 has an aperture 22 formed therethrough downwardly of the first end 14. The aperture 22 serves to allow the vertical rectangular base 12 to be mounted to a wall. The rectangular base 12 can be simply mounted on the wall by a large screw or nail.

An upper panel 26 is integral with the vertical rectangular base 12 downwardly of the aperture 22 formed therethrough. The upper panel 26 extends outwardly from the rectangular base 12 from the two side portions 20 thereof. The upper panel 26 is perpendicular to the rectangular base 12. The upper panel 26 has a plurality of soft foam strips 28 that are secured to a front surface thereof. The plurality of soft foam strips 28 serve to receive fishing rod tips securably therein. The soft foam strips 28 protect the tips when they are in place within the upper panel 26. The soft foam strips 28 are positioned on the upper panel 26 where it extends outwardly from the rectangular base 12.

The device 10 contains an upper shelf 32 having an upper surface 34, a lower surface 36, a front end 38, and a back end 40. The back end 40 has an extension 42 integral therewith. The front end 38 has a plurality of cutouts 44 therein. The cutouts 44 serve to allow hip boots or chest waders to be hung therefrom. The lower surface 36 of the extension 42 has an upper portion 46 of a shelf bracket secured thereto. A lower portion 48 of the shelf bracket is secured to the intermediate extent 18 of the vertical rectangular base 12 downwardly of the upper panel 26. A hook 50 is secured to the lower surface 36 of the upper shelf 32 inwardly of the front end 38. The hook 50 allows a user to hang a fishing vest or a fishing net thereto. The extension 42 is aligned with the vertical rectangular base 12 so that the fishing rods are not impaired by the upper shelf 32 as the rods pass behind the upper shelf 32 to the upper panel 26.

The device 10 contains a middle shelf 52 having an upper surface 54, a lower surface 56, a front end 58, and a back end 60. The back end 60 has an extension 62 integral therewith. The lower surface 56 of the extension 62 has an upper portion 46 of a shelf bracket secured thereto. A lower portion 48 of the shelf bracket is secured to the intermediate extent 18 of the vertical rectangular base 12 downwardly of the upper shelf 32. The extension 62 has an identical design to the extension 42 of the upper shelf 32 and an identical purpose. The middle shelf 52 is preferably made to be smaller than the upper shelf 32 to fit a smaller sized tackle box thereon, such as a fresh water tackle box.

The device 10 contains a lower shelf 66 having an upper surface 68, a lower surface 70, a front end 72, and a back end 74. The back end 74 has an extension 76 integral therewith. The lower surface 70 of the extension 76 has an upper portion 46 of a shelf bracket secured thereto. A lower portion 48 of the shelf bracket is secured to the intermediate extent 18 of the vertical rectangular base 12 downwardly of the middle shelf 52. The extension 76 has an identical design to the extension 42 of the upper shelf 32 and an identical purpose. The lower shelf 66 is preferably larger than the middle shelf 52 to fit a larger sized tackle box thereon, such as a salt water tackle box.

A bottom panel 80 is integral with the vertical rectangular panel 12 upwardly of the second end 16 thereof. The bottom panel 80 extends outwardly from the rectangular base 12 from the two side portions 20 thereof. The bottom panel 80 has a plurality of recesses 82 therein. The recesses 82 serve to receive ends of the fishing rods therein. By placing the end of the fishing rod within the recess, the user can pass the rod behind the lower shelf, the middle shelf, and the upper shelf, and positioned within the soft foam strips of the upper panel. This keeps the rod or rods protected and out of the way for retrieving items off of the shelves.

The present invention is an organizational device used to store fishing gear so that it can be kept in one place.

This device is approximately four feet tall, thirty-six inches wide, and eighteen inches deep. It consists of a vertical rectangular base, an upper panel, an upper shelf, two middle shelves, and a bottom panel. It is attached to a wall by a mounting hole in the top of the base. Beneath this hole is the upper rectangular panel that has soft foam strips on it through which the fishing rod ends are inserted. Under this is the top shelf which has cutouts so that hip boots or chest waders can be hung upside down to prevent creases from forming in the boots. The two middle shelves are below this. At the bottom is a panel which holds the ends of the fishing poles. The assembly is made from plastic, but a deluxe model could be made from a hardwood with fancy scroll work.

The device is hung on a convenient wall and gear is stored in the appropriate place. One of the middle shelves can be used for a freshwater tackle box and the other for a saltwater box, if desired.

This convenient storage rack enables the user to have all fishing gear in one spot in the home. The shelves are adjustable and have ridges around their edges to keep items from falling off. The rod supports are located in back of the shelves for additional protection for expensive fishing poles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved fishing equipment storage apparatus for organizing fishing gear so that it can all be kept in one place comprising, in combination:

a vertical rectangular base having a first end, a second end, an intermediate extent therebetween, and two side portions, the rectangular base having an aperture formed therethrough downwardly of the first end, the aperture serving to allow the vertical rectangular base to be mounted to a wall;

an upper panel integral with the vertical rectangular base downwardly of the aperture formed therethrough, the upper panel extending outwardly from the rectangular base from the two side portions thereof, the upper panel having a plurality of soft foam strips secured to a front surface thereof, the plurality of soft foam strips serving to receive fishing rod tips securably therein;

an upper shelf having an upper surface, a lower surface, a front end, and a back end, the back end having an extension integral therewith, the front end having a plurality of cutouts therein, the cutouts serving to allow hip boots or chest waders to be hung therefrom, the lower surface of the extension having an upper portion of a first shelf bracket secured thereto, a lower portion of the first shelf bracket secured to the intermediate extent of the vertical rectangular base downwardly of the upper panel, a hook secured to the lower surface of the upper shelf inwardly of the front end;

a middle shelf having an upper surface, a lower surface, a front end, and a back end, the back end having an extension integral therewith, the lower surface of the extension having an upper portion of a second shelf bracket secured thereto, a lower portion of the second shelf bracket secured to the intermediate extent of the vertical rectangular base downwardly of the upper shelf;

a lower shelf having an upper surface, a lower surface, a front end, and a back end, the back end having an extension integral therewith, the lower surface of the extension having an upper portion of a third shelf bracket secured thereto, a lower portion of the third shelf bracket secured to the intermediate extent of the vertical rectangular base downwardly of the middle shelf;

a bottom panel integral with the vertical rectangular panel upwardly of the second end thereof, the bottom panel extending outwardly from the rectangular base from the two side portions thereof, the bottom panel having a plurality of recesses therein, the recesses serving to receive ends of the fishing rods therein.

2. A new and improved fishing equipment storage apparatus for organizing fishing gear so that it can all be kept in one place comprising, in combination:

a vertical rectangular base having an aperture formed therethrough, the aperture serving to allow the vertical rectangular base to be mounted to a wall;

an upper panel integral with the vertical rectangular base downwardly of the aperture formed therethrough, the upper panel having a plurality of soft foam strips secured to a front surface thereof, the plurality of soft foam strips serving to receive fishing rod tips securably therein;

an upper shelf having an extension integral therewith, the extension having an upper portion of a first shelf bracket secured thereto, a lower portion of the first shelf bracket secured to the vertical rectangular base downwardly of the upper panel;

a bottom panel integral with the vertical rectangular base upwardly of a lower end thereof, the bottom panel having a plurality of recesses therein, the recesses serving to receive ends of the fishing rods therein; and, wherein fishing rods having tips in the foam strips and ends in the recesses pass behind the upper shelf as provided by the extension.

3. The apparatus as described in claim 2 and wherein the upper shelf has a plurality of cutouts therein, the cutouts serving to allow hip boots or chest waders to be hung therefrom.

4. The apparatus as described in claim 3 and further including a hook secured to a lower surface of the upper shelf.

5. The apparatus as described in claim 4 and further including a middle shelf having an upper surface, a lower surface, a front end, and a back end, the back end having an extension integral therewith, the lower surface of the extension having an upper portion of a second shelf bracket secured thereto, a lower portion of the second shelf bracket secured to the vertical rectangular base downwardly of the upper shelf.

6. The apparatus as described in claim 5 and further including a lower shelf having an upper surface, a lower surface, a front end, and a back end, the back end having an extension integral therewith, the lower surface of the extension having an upper portion of a third shelf bracket secured thereto, a lower portion of the third shelf bracket secured to the vertical rectangular base downwardly of the middle shelf.

* * * * *